US008887330B2

(12) United States Patent
Grinberg et al.

(10) Patent No.: US 8,887,330 B2
(45) Date of Patent: Nov. 18, 2014

(54) WEIGHT-STABILIZING STRETCHER

(71) Applicants: Joshua Grinberg, Newton, MA (US); Shane Skikne, Middleton, MA (US); Alex Deardorff, Newton, NH (US); Ben Deardorff, Newton, NH (US)

(72) Inventors: Joshua Grinberg, Newton, MA (US); Shane Skikne, Middleton, MA (US); Alex Deardorff, Newton, NH (US); Ben Deardorff, Newton, NH (US)

( * ) Notice: Subject to any disclaimer, the term of this patent is extended or adjusted under 35 U.S.C. 154(b) by 0 days.

(21) Appl. No.: 13/930,625

(22) Filed: Jun. 28, 2013

(65) Prior Publication Data

US 2014/0007350 A1 Jan. 9, 2014

Related U.S. Application Data

(62) Division of application No. 12/813,923, filed on Jun. 11, 2010, now Pat. No. 8,474,077.

(51) Int. Cl.

| | |
|---|---|
| ***A47B 1/00*** | (2006.01) |
| ***A61G 1/048*** | (2006.01) |
| ***A61G 1/00*** | (2006.01) |

(52) U.S. Cl.

CPC . *A61G 1/048* (2013.01); *A61G 1/00* (2013.01)
USPC ..... 5/628; 5/625; 5/626; 5/627

(58) Field of Classification Search

USPC ..... 5/625–628; 296/20; 16/438, 436
See application file for complete search history.

(56) References Cited

U.S. PATENT DOCUMENTS

| | | | | | |
|---|---|---|---|---|---|
| 1,129,089 | A * | 2/1915 | Hajas | 5/627 |
| 2,708,276 | A * | 5/1955 | Schloss et al. | 5/111 |
| 3,110,912 | A * | 11/1963 | Propst | 5/628 |
| 4,679,260 | A * | 7/1987 | Frettem | 5/627 |
| 4,685,161 | A * | 8/1987 | Zalman | 5/627 |
| 4,930,831 | A * | 6/1990 | Valiga et al. | 269/26 |
| 5,327,600 | A * | 7/1994 | Hoogendoorn | 5/625 |
| 5,375,277 | A * | 12/1994 | Carr et al. | 5/625 |
| 5,402,543 | A * | 4/1995 | Dietrich et al. | 5/610 |
| 5,539,945 | A * | 7/1996 | Rosenberg et al. | 5/626 |
| 5,857,695 | A * | 1/1999 | Crowell | 280/651 |
| 6,718,580 | B2 * | 4/2004 | Heimbrock et al. | 5/617 |
| 7,017,940 | B2 * | 3/2006 | Hatfull | 280/652 |
| 7,150,465 | B2 * | 12/2006 | Darling, III | 280/640 |
| 7,199,311 | B1 * | 4/2007 | Buckner et al. | 177/144 |
| 7,258,310 | B2 * | 8/2007 | Norris | 248/125.7 |
| 7,462,009 | B2 * | 12/2008 | Hartmann et al. | 414/434 |
| 7,631,373 | B2 * | 12/2009 | Broadley et al. | 5/86.1 |
| 7,837,595 | B2 * | 11/2010 | Rice | 482/4 |
| 8,127,381 | B2 * | 3/2012 | Westmoreland et al. | 5/627 |
| 8,209,802 | B2 * | 7/2012 | Linares | 5/625 |
| 8,327,482 | B2 * | 12/2012 | Awerbuch et al. | 5/627 |
| 8,474,077 | B2 * | 7/2013 | Grinberg et al. | 5/628 |

(Continued)

*Primary Examiner* — Robert G Santos
*Assistant Examiner* — David E Sosnowski
(74) *Attorney, Agent, or Firm* — Wilmer Cutler Pickering Hale and Dorr LLP

(57) ABSTRACT

A flat backboard for an injured person to lie upon is supported between two rigid support poles. The support poles are connected at each end of the stretcher to each other by an elevated support assembly. The support assembly has a handlebar structure and a mount assembly; this mount assembly has a central axle, around which the handlebar assembly fits, allowing for the handlebars to rotate without the mount assembly or the backboard rotating. When the holder of the handlebars generates a rocking motion, the central shaft rotates in the mount assembly, such that the weight of the injured person is supported by the mount assembly, but the rocking motion is not communicated to the mount assembly or the backboard.

6 Claims, 6 Drawing Sheets

(56) References Cited

U.S. PATENT DOCUMENTS

| | | | | |
|---|---|---|---|---|
| 2007/0101501 | A1* | 5/2007 | Tomcany et al. | 5/626 |
| 2007/0281828 | A1* | 12/2007 | Rice | 482/4 |
| 2011/0099717 | A1* | 5/2011 | Windauer | 5/627 |
| 2011/0192942 | A1* | 8/2011 | Liu | 248/166 |
| 2011/0302718 | A1* | 12/2011 | Grinberg et al. | 5/628 |
| 2012/0272451 | A1* | 11/2012 | Haskell et al. | 5/628 |
| 2014/0007350 | A1* | 1/2014 | Grinberg et al. | 5/625 |

* cited by examiner

WEIGHT-STABILIZING STRETCHER

CROSS-REFERENCE TO RELATED APPLICATION

This application is a divisional of U.S. patent application Ser. No. 12/813,923, filed Jun. 11, 2010, which is pending.

FIELD OF THE INVENTION

This invention relates to a stretcher for transportation of injured persons, and in particular to a stretcher or stretcher-attachment with a weight-stabilizing feature.

BACKGROUND

Stretchers are typically used for medical evacuation of injured persons from the site of injury to a medical vehicle such as an ambulance or helicopter. Some stretchers are intended to be highly portable, to be carried long distances by military or emergency personnel into regions inaccessible by vehicular transport; others are intended to be used in environments that are easily accessible by vehicle, and are correspondingly heavier; others, such as wheeled hospital gurneys, are designed with wheels and stands that can be used on level surfaces.

Often, injured persons are subject to jostling and rocking during transport on a standard stretcher. Lateral rotation is generated any time the persons transporting the stretcher are traveling on uneven terrain or are climbing up or down a grade. Even when the person on the stretcher is firmly strapped to the backboard, any rocking motion on the part of the persons holding the stretcher on either side is transmitted to the backboard. This is particularly problematic for back and spine injuries, but can be a problem for persons with all types of injuries.

Indeed, the reduction of unnecessary back and spinal motion is a standard part of modern emergency medical procedure. A common device used for this purpose is a long spine board, also called a backboard and made of plastic or other X-ray translucent materials, on which the injured person is placed. Other devices such as a cervical collar, side head supports or blocks, and straps are used in conjunction to immobilize the patient. In cases where rapid vehicle extraction is desired, often devices are used such as the Kendrick Extrication Device, which is a padded device with built-in straps designed to immobilize a person in an anatomically neutral position.

However, such immobilizing devices are not useful in reducing back and spinal motion due to motion of the stretcher, as the immobilizing devices themselves are only secured to the stretcher. What is needed is a mechanism for separating the rocking motion of the persons carrying the stretcher from the actual stretcher itself.

SUMMARY

In some embodiments, a flat backboard for the injured person to lie upon is supported between two rigid support poles. At each end, the support poles connect to a support assembly. The support assembly includes a handlebar structure and a mount assembly. The mount assembly connects to the support poles and includes an axle parallel to the orientation of the stretcher onto which the handlebar assembly is fitted, to provide a pivot joint. The pivot joint allows the handlebars to rotate without the mount assembly or the backboard rotating. When the movement of a holder of the handlebars causes the handlebars to rock or tilt, the handlebar structure rotates about the axle of the mount assembly, such that the weight of the injured person is supported by the joint, but the rocking motion is not communicated to the backboard. This separates the rocking motion of the persons carrying the stretcher from the actual stretcher itself and the patient lying on the stretcher.

In other embodiments, the invention includes a support assembly configured to be connected to an end of a backboard stretcher. The support assembly includes a handlebar structure and a mount assembly. The mount assembly is configured to connect to an end of the stretcher, and includes an axle onto which the handlebar assembly is fitted, to provide a pivot joint.

In other embodiments, the invention includes a weight-stabilizing assembly that includes a mount assembly adapted for coupling with a load-bearing structure, such as a stretcher, a handlebar, and a detachable pivot joint rotatably coupling the handlebar to the mount assembly.

DETAILED DESCRIPTION

A stretcher for weight stabilization is provided, often for use in field environments.

Figure 1:
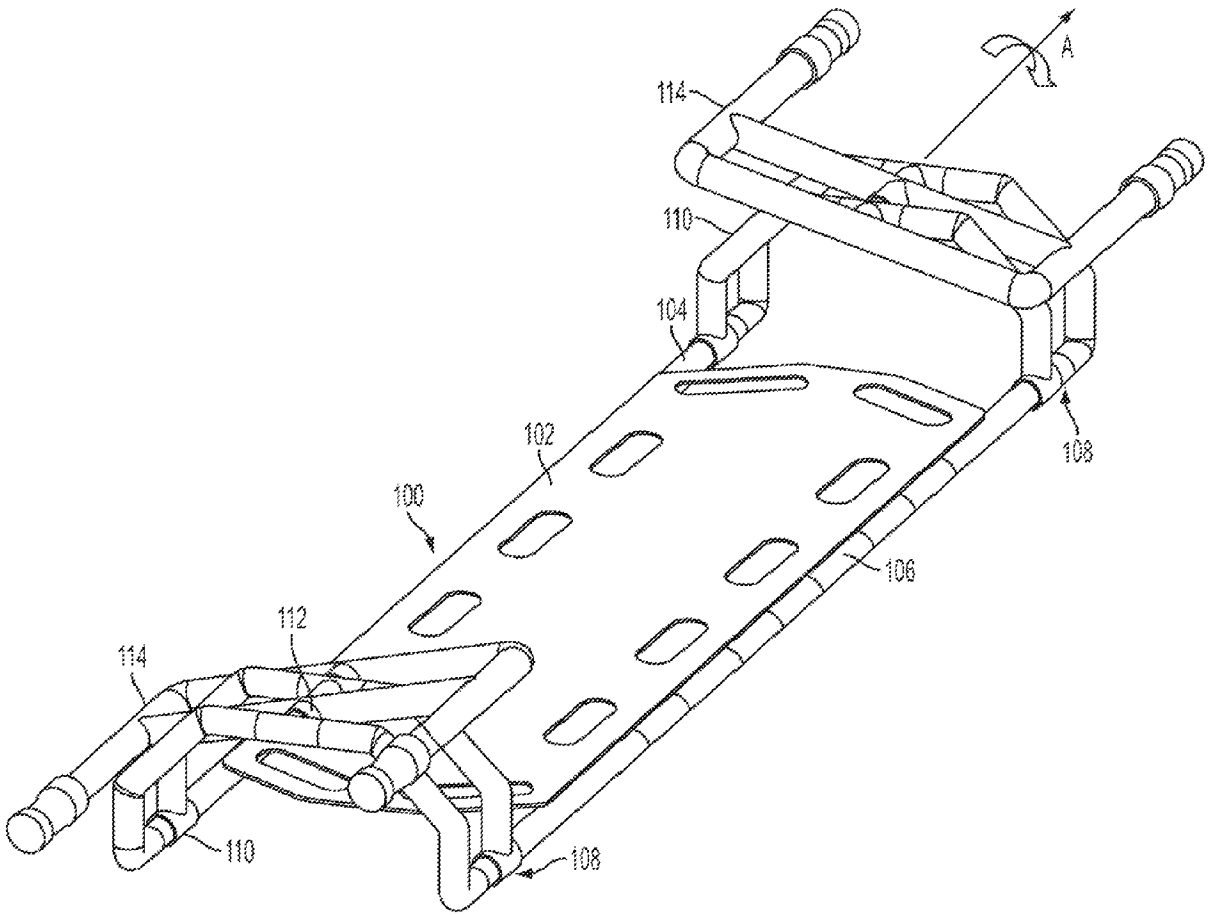
FIG. 1 is a perspective drawing of a complete stretcher assembly with backboard and handlebar attached via a pivot joint, according to an embodiment of the invention.
Figure 2:
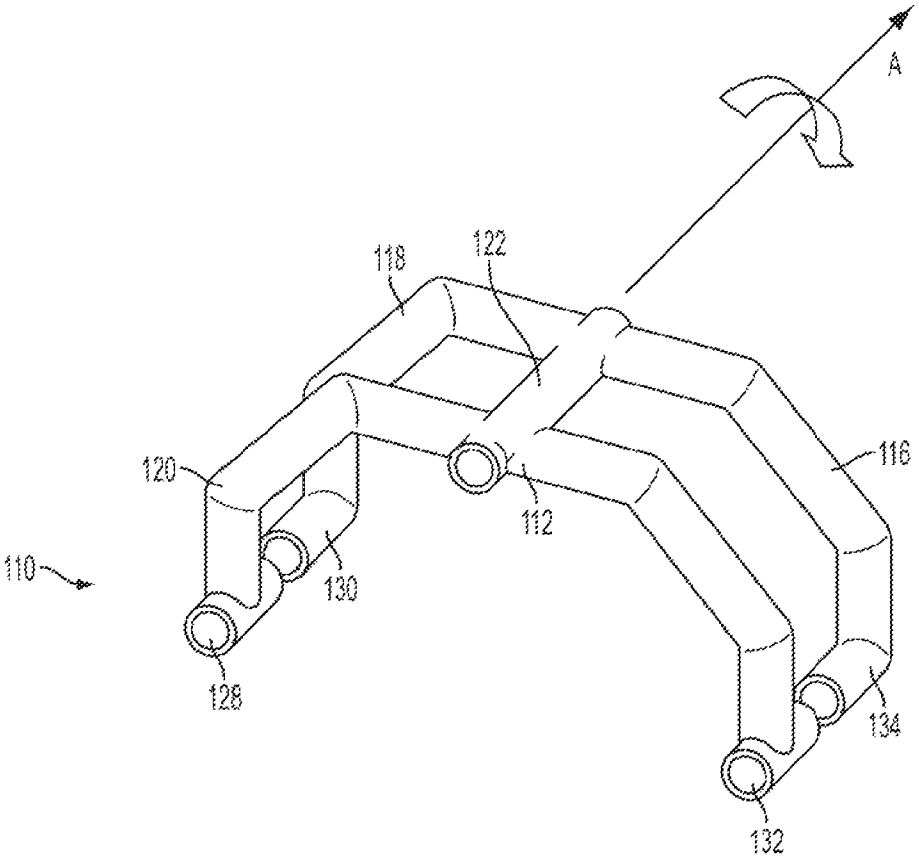
FIG. 2 is a perspective drawing of the handlebar of FIG. 1.

As shown in FIG. 1, a stretcher 100 includes a backboard 102 supported between two support poles 104, 106 which are coupled on each end to a support assembly 108. The support assembly 108 includes a mount assembly 110 coupled to poles 104, 106. Mount assembly 110 also is coupled at a pivot joint 112 to handlebars 114. Handlebars 114 otherwise are not coupled to the backboard 102. As shown in FIGS. 1 and 2, pivot joint 112 has a rotational axis A. As the handlebars 114 are rotated around the pivot joint 112, the rotational motion is isolated to the handlebars 114, and is not transmitted to the rest of the stretcher 100.

As shown in FIG. 2, each mount assembly 110 includes two parallel arched pieces 118, 120; the top or peak of each arched piece 118, 120 is joined by axle 122. The bottom ends of inner arched piece 120 is connected to left and right inner horizontal pieces 128 and 132. The bottom ends of outer arched piece 118 are connected to outer left and right horizontal pieces 130 and 134. Inner horizontal pieces 128 and 132 are coupled to poles 104, 106. Left horizontal pieces 128 and 130 may be connected together or may be formed as a single piece. Similarly, right horizontal pieces 132 and 134 may be connected together or may be formed as a single piece.

Figure 3:
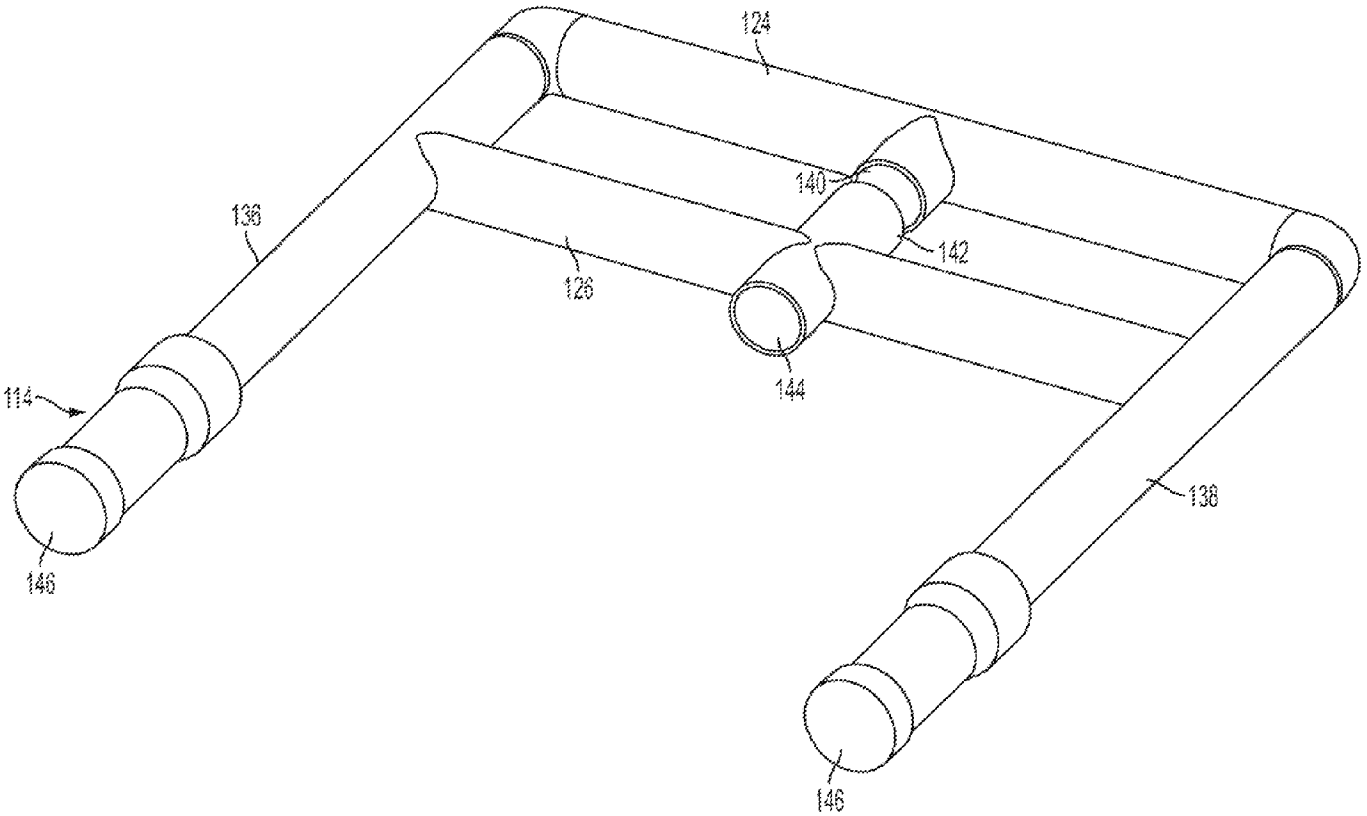
FIG. 3 is a perspective drawing of the backboard of FIG. 1, upon which the injured person is placed and immobilized.

As shown in FIGS. 2 and 3, each handlebar 114 includes inner crossbar 124 and outer crossbar 126 connecting left handle 136 and right handle 138. Inner crossbar 124 includes an opening 140 along rotational axis A. the main longitudinal axis of the stretcher, and outer crossbar 126 includes two openings 142, 144 along the rotational axis A. The opening 140 in inner crossbar 124 only exists on one side, to accommodate an end of axle 122. The openings 142, 144 in outer crossbar 126 provide a passage to accommodate axle 122 for pivot joint 112. The openings in inner crossbar 124 and outer crossbar 126 allow handlebars 114 to rotate about axle 122. Together, outer crossbar 126 and axle 122 form pivot joint 112.

The pivot joint 112 has one degree of freedom, which is rotation along rotational axis A. The pivot joint 112 optionally includes ball bearings. The pivot joint may be constructed in the form of a hinge connecting handlebars 114 and mount assembly 110. The hinge may allow only a limited angle of rotation about rotational axis A. The handlebars 114 rotate about the hinge relative to mount assembly 110. In some embodiments, the hinge includes axle 122. In other embodiments, axle 122 is omitted. In different embodiments, the pivot joint 112 may provide a looser or tighter fit between the crossbars 124, 126 and axle 122, such that different levels of damping are provided to the person on the stretcher. In some embodiments, a shell on handlebar 114 or mount assembly 110 may surround any otherwise exposed portion of axle 122 to lessen the chance that debris enters the pivot joint 112.

In some embodiments, left handle 136 and right handle 138 are spaced by a width that is optimized for a person carrying the device, i.e., roughly shoulder-width apart. This width may be somewhat greater or less than the distance between the two support poles 104, 106 which support the backboard 102. In some embodiments, handles 136, 138 are equipped with grips 146, which provide comfort and support for the persons carrying the stretcher. Although two crossbars 124, 126 are shown, in other embodiments a single crossbar can be used.

In some embodiments, the handlebars 114, in conjunction with mount assembly 110, provide a limited range of motion, thereby preventing large rotations that could cause the person on the stretcher to fall out. Angled portion 116 on either side of arched pieces 118, 120 stops handle 136 or 138 if the stretcher rotates beyond an allowed range of motion relative to the handles. By altering the angle of angled portion 116, or the shape of arched pieces 118 and 120, the allowable range of motion can be increased or decreased.

Figure 4:
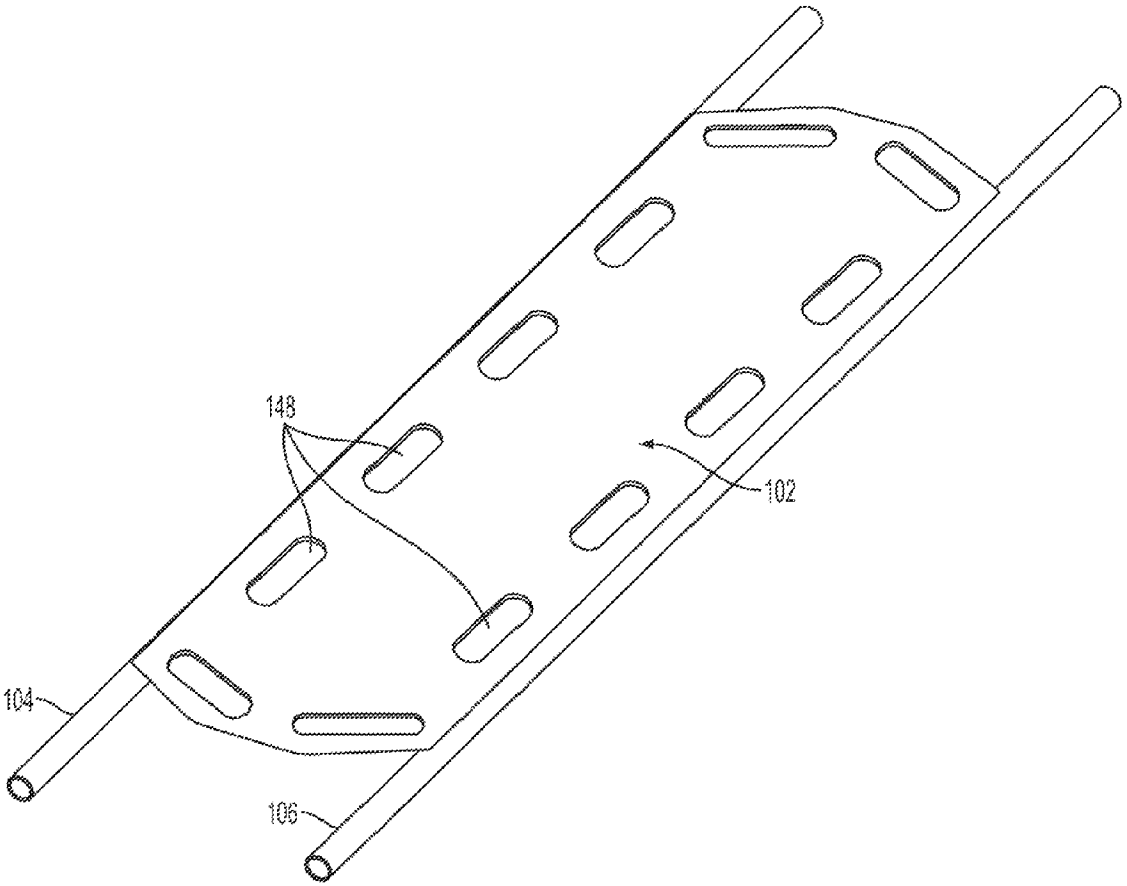
FIG. 4 is a perspective drawing of the pivot joint and surrounding structures of FIG. 1.

FIG. 4 depicts the backboard 102, upon which the injured person is laid and secured. In the depicted embodiment, notches 148 allow for the attachment of straps (not shown) for securing the person. Varying sizes of backboards are employed in various embodiments. In some embodiments, the injured person may be laid with their head positioned toward either side of the backboard. The handlebars are raised from the backboard and horizontal pieces 128, 130, 132, 134 by approximately eight inches, or more, to reduce the likelihood that the patient laying on the stretcher will strike the handlebars. While depicted with no crossbars between the poles 104, 106 at the ends of the stretcher, in an alternative embodiment, crossbars could be placed at the ends of poles 104, 106 or on support assembly 108 at the same level as the backboard 102.

In some embodiments, horizontal pieces 128, 132 are hollow, and poles 104, 106 fit into the hollow pieces. The joints between the support assembly 108 and the support poles 104, 106 may be secured with glue or other adhesive. In other embodiments, this joint may be detachable, and secured using other structures that allow for quick assembly and disassembly. For instance, interlocking tubes fastened by screws, washers and nuts, locking grooves, or other fastening mechanisms can be used; such mechanisms are well known in the art. In other embodiments, the support assembly 108 may be connected to the support poles 104, 106 and/or backboard 102 at multiple points.

In some embodiments, a single arched piece is used instead of two. In different embodiments the support assembly 108 can be provided as part of the stretcher or as a separate component that is added to an otherwise finished stretcher. In some embodiments, the device is formed using aluminum, such as hollow aluminum tubes; in other embodiments, different materials, such as plastic and/or other lightweight metals, are used.

In some embodiments, hooks enabling the attachment of tools and medical supplies are provided at different points on the stretcher, such as on mount assembly 110, handlebar 114, or support poles 104, 106. In other embodiments, a harness is attached to the stretcher to allow persons carrying the stretcher partially to support the weight of the stretcher with their bodies as well as by carrying with their arms. The harness may be attached at handlebar 114 or mount assembly 110. The harness may attach at the handlebar on the side opposite from the arm or shoulder it is supported by, thereby crossing the holder.

In yet another embodiment, the backboard 102 and support poles 104, 106 are collapsible to facilitate transportation of the stretcher into remote areas. For example, the backboard and support poles may be designed to separate into three or more interlocking segments, such as by using hollow pipes, such that the pipes fit into each other for ease of transportation. When the stretcher is assembled, the pipes can be fastened with screws, pins, nuts or other fasteners as is well-known in the art.

Figure 5:
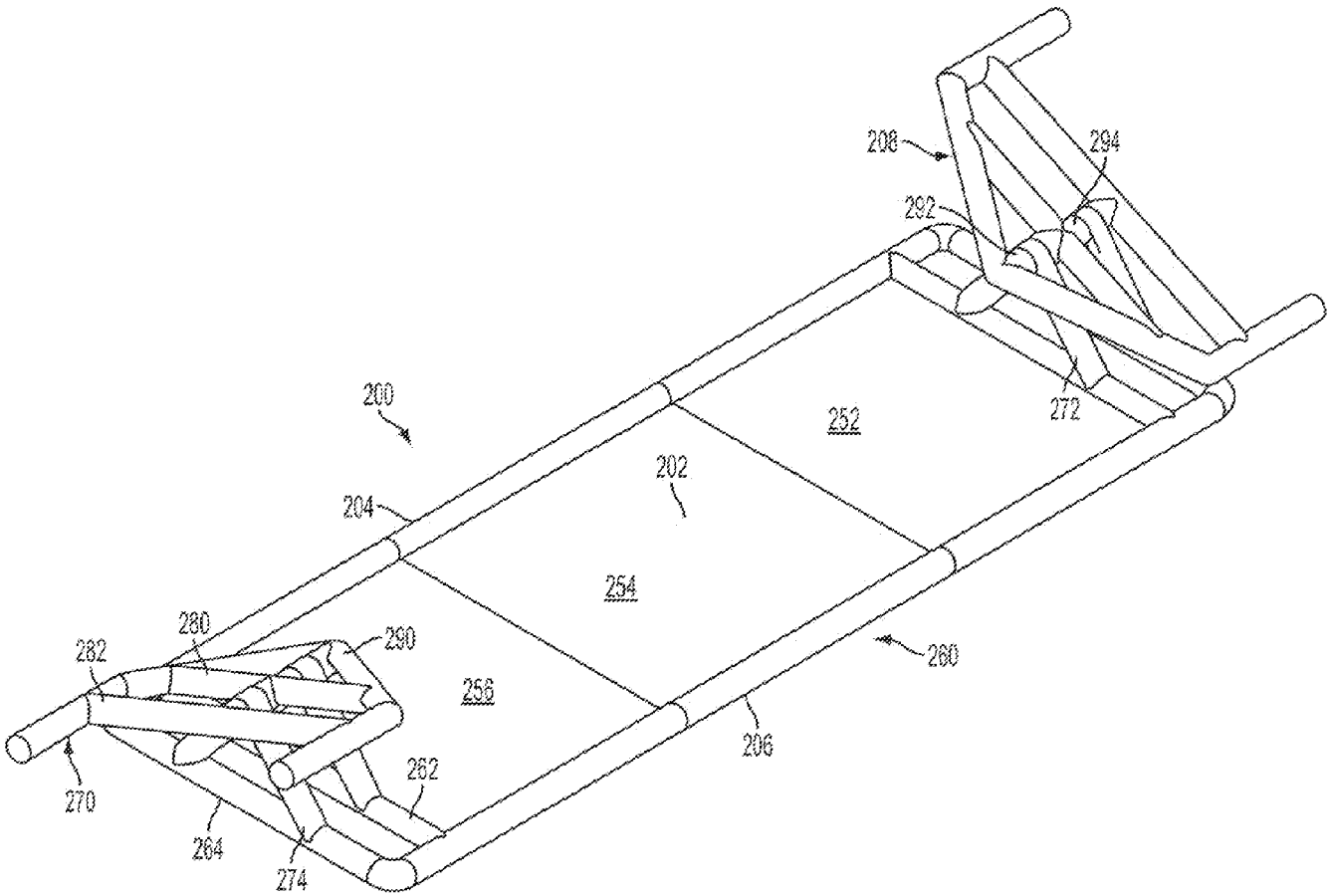
FIG. 5 is a perspective drawing of an alternative design.

An alternative embodiment is shown in FIG. 5. In this embodiment, stretcher 200 includes backboard 202 supported around its perimeter by frame 260. Frame 260 includes side poles 204, 206, and on each end inner pole 262 and outer pole 264. Support assembly 208 includes handlebar 270, inner handle support 272, and outer handle support 274. Handlebar 270 has an "A" shape, with two crosspieces: inner crosspiece 280 and outer crosspiece 282. Handlebar 270 also includes post 292 extending from the apex 290 of the "A" to inner crosspiece 280, and post 294 extending from inner crosspiece 280 to outer crosspiece 282. Posts 292 and 294 are co-linear. Inner handle support 272 includes an opening at its top to accommodate post 292, and outer handle support 274 includes an opening at its top to accommodate post 294. Handlebar 270 is able to rotate within the openings in inner handle support 272 and outer handle support 274.

Figure 6:
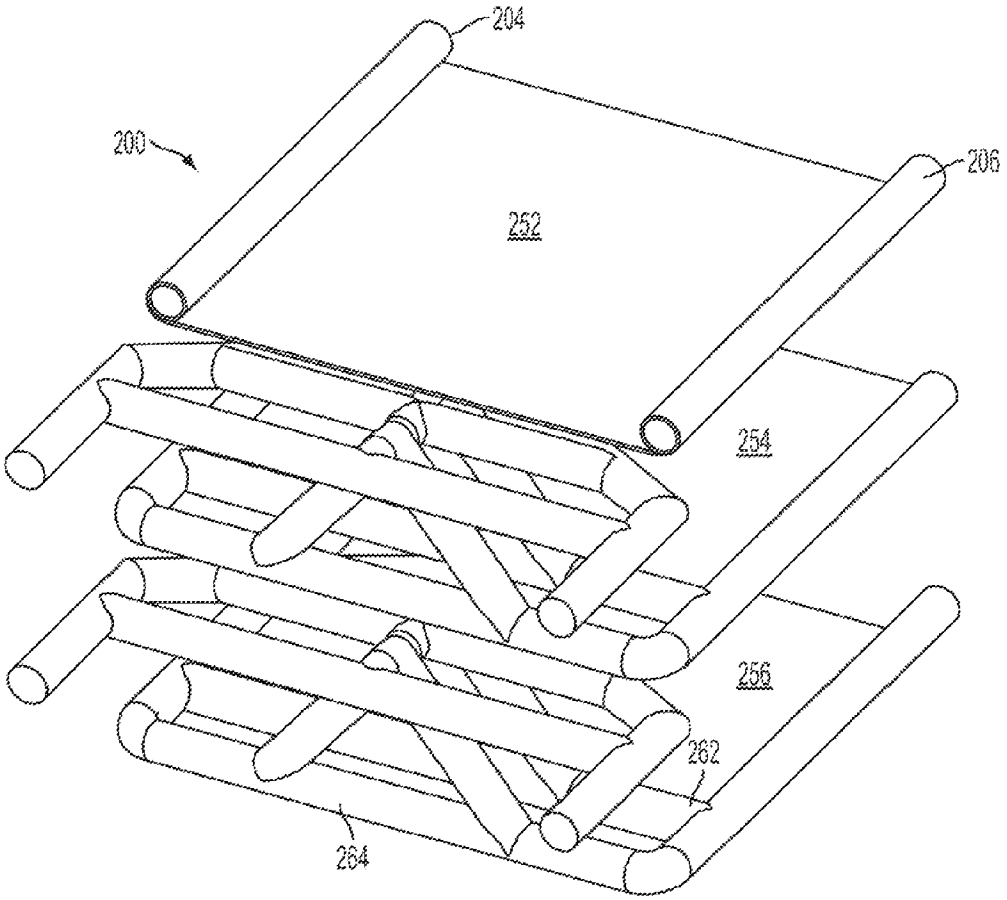
FIG. 6 is a perspective drawing of the alternative design of FIG. 5, showing the stretcher separated into pieces.

As shown in FIG. 6, stretcher 200 can be separated into pieces 252, 254, 256 for easier transportation Inner pole 262, outer pole 264, and support assembly 208 remain part of end pieces 284 or 286. To assemble stretcher 200, the three pieces 252, 254, 256 are arranged in sequence, and then the individual components of side poles 204, 206 are inserted into the adjacent components and fastened with screws or bolts.

Unlike the embodiment disclosed in FIGS. 1-4, the embodiment of FIG. 5 does not use an axle on the mount assembly. Instead, the embodiment of FIG. 5 has posts 292, 294 on handlebar 270 to permit handlebar 270 to rotate within the openings in handle supports 272, 274. Additionally, with the embodiment disclosed in FIGS. 1-4, unlike with the handle supports 272, 274 of the embodiment disclosed in FIG. 5, arched pieces 118, 120 extend to the sides of the stretcher, out of the way of the head of a patient or other medical supplies on the stretcher. The embodiment disclosed in FIGS. 1-4 does not include the two parallel poles 262, 264 beneath the mount assembly that extend from side to side, and that are present in the embodiment disclosed in FIG. 5. This permits the embodiment disclosed in FIGS. 1-4 to use less material, reducing the cost and weight.

In the embodiment of FIG. 5, unlike the embodiment disclosed in FIGS. 1-4, the support assembly is not detachable from the stretcher. Rather, as shown in FIG. 5, the mount assembly is integral with poles 262, 264 of stretcher frame 260. In a further alternative embodiment, a detachable support assembly, as disclosed in FIGS. 1-4, could be combined with a stretcher that can be separated into multiple pieces, as shown in FIGS. 5 and 6.

Although the above description has been presented in the content of a stretcher or support assembly for attachment to a stretcher, in some embodiments the support assembly is attached to load-bearing structures other than stretchers, such as pallets of goods, chairs, trunks, or light machinery. Such embodiments are particularly useful on terrain where wheeled carriers are not appropriate.

Other embodiments are also within the scope of the present invention. Although the invention has been described and illustrated in the foregoing illustrative embodiments, it will be understood that extensions and modifications of the ideas presented above are comprehended and should be within the reach of one versed in the art upon reviewing the present disclosure. Accordingly, the scope of the present invention in its various aspects should not be limited by the examples presented above. The individual aspects of the present invention, and the entirety of the invention, should be regarded so as to allow for such design modifications and future developments. The present invention is limited only by the claims that follow.

What is claimed is:

1. A support assembly for weight stabilization of a stretcher comprising:

a rigid mount assembly adapted for coupling to a stretcher, the rigid mount assembly including an axle; and a handlebar assembly rotatably coupled with the axle;

wherein the rigid mount assembly further includes left and right horizontal supports adapted for coupling to a stretcher, an inner arch connected at a first end to the left support and at a second end to the right support, and an outer arch connected at a first end to the left support and at a second end to the right support, wherein the axle extends from a peak of the inner arch to a peak of the outer arch.

2. The support assembly of claim 1, wherein the handlebar assembly further includes a left handle, a right handle, an inner crossbar extending from the left handle to the right handle, and an outer crossbar extending from the left handle to the right handle, wherein the axle fits within a central opening in the inner crossbar.

3. The support assembly of claim 2, wherein the axle and the inner crossbar form a pivot joint.

4. The support assembly of claim 2, wherein the left handle, the right handle, the inner crossbar, and the outer crossbar define a plane.

5. The support assembly of claim 1, wherein the rigid mount assembly positions the handlebar assembly at least about 8 inches above the left and right horizontal supports.

6. A support assembly for weight stabilization of a stretcher comprising:

a rigid mount assembly adapted for coupling to a stretcher, the rigid mount assembly including an axle; and a handlebar assembly rotatably coupled with the axle;

wherein the handlebar assembly further includes a left handle, a right handle, an inner crossbar extending from the left handle to the right handle, and an outer crossbar extending from the left handle to the right handle, wherein the axle fits within a central opening in the inner crossbar.

* * * * *